US005206210A

United States Patent [19]

Tsuchida et al.

[11] Patent Number: 5,206,210

[45] Date of Patent: Apr. 27, 1993

[54] HEAT-SENSITIVE RECORDING MATERIAL

[75] Inventors: Tetsuo Tsuchida, Takarazuka; Yukihiro Abe, Kobe; Takehiro Minami, Osaka; Naoto Arai, Ikeda, all of Japan

[73] Assignee: Kanzaki Paper Manufacturing Co., Ltd., Japan

[21] Appl. No.: 734,745

[22] Filed: Jul. 23, 1991

[30] Foreign Application Priority Data

Jul. 23, 1990 [JP] Japan ..... 2-196532
Jul. 23, 1990 [JP] Japan ..... 2-196533

[51] Int. Cl.[5] ..... B41M 5/32

[52] U.S. Cl. ..... 503/210; 503/211; 503/212; 503/216; 503/217; 503/221

[58] Field of Search ..... 503/210–212, 503/216, 217, 225, 221

[56] References Cited

U.S. PATENT DOCUMENTS

| | | | |
|---|---|---|---|
| 3,924,027 | 12/1975 | Saito et al. | 427/150 |
| 4,134,847 | 1/1979 | Oda et al. | 503/216 |
| 4,236,732 | 12/1980 | Murakami et al. | 428/913 |
| 4,352,860 | 10/1982 | Kubo et al. | 428/913 |

FOREIGN PATENT DOCUMENTS

| | | |
|---|---|---|
| 0249885 | 12/1987 | European Pat. Off. . |
| 0275203 | 7/1988 | European Pat. Off. . |
| 2215713 | 3/1972 | Fed. Rep. of Germany . |
| 2216676A | 3/1989 | United Kingdom . |

OTHER PUBLICATIONS

Patent Abstracts of Japan, vol. 13, No. 519 (M-895) (3867) published on Nov. 20, 1989 (Japanese Unexamined Patent Publication 1-209184 published on Aug. 22, 1989).

*Primary Examiner*—Pamela R. Schwartz
*Attorney, Agent, or Firm*—Larson and Taylor

[57] ABSTRACT

Disclosed is a heat-sensitive recording material comprising (A) a support and (B) a heat-sensitive recording layer formed on the support and containing a colorless or pale-colored basic dye and a color developing material which develops a color on contact with the dye, the recording material being characterized in that the color developing material comprises at least one member selected from the group consisting of o-naphthoic acid and polyvalent metal salts thereof.

20 Claims, No Drawings

HEAT-SENSITIVE RECORDING MATERIAL

The present invention relates to a heat-sensitive recording material and more particularly to a heat-sensitive recording material which is excellent particularly in color-forming ability, storage stability and stability of record image.

Heat-sensitive recording materials are well known which make use of the color forming reaction of a colorless or pale-colored basic dye with a color developing material such that the two materials are brought into contact with each other by heating to produce a color image.

With the recent remarkable development of heat-sensitive recording systems, the heat-sensitive recording materials find various uses in various forms. They are not only used as recording media for facsimile or thermal printer but also increasingly introduced into new uses such as POS (point of sales) labels.

However, heat-sensitive recording materials generally have drawbacks of being poor in storage stability and in resistance to various chemicals. Thus, when the heat-sensitive recording materials are stored under a high temperature or high humidity condition or are brought into contact with solvent, plasticizers or other chemicals, fogging (i.e., undesired color formation in the background white portion of the recording material) would be caused or the record images would be discolored or reduced in color density. For example, undesired color formation takes place in the white portion of the heat-sensitive recording layer or the record image becomes discolored or reduced in color density when the heat-sensitive recording materials are contacted with an ink such as one used for water-based ink pens, oil-based ink pens or fluorescent ink pens, cinnabar seal-ink, adhesives, pastes, diazo developers and other writing materials or office instruments; with cosmetics such as hand cream, hair tonics or milky lotions; or with polyvinyl chloride film or like wrapping materials containing a plasticizer.

For this reason, it is strongly desired to develop a heat-sensitive recording material which is excellent in storage stability and resistance to chemicals, especially in the stability of the record image and in the effect of preventing fogging.

Under the circumstances, in an attempt to alleviate the above problems of the heat-sensitive recording materials which make use of the color forming reaction of a basic dye and a color developing material, we have conducted extensive research especially on the color developing materials. As a result, we have found that a heat-sensitive recording material which is excellent not only in the color forming ability and storage stability but also in the stability of the record image can be obtained when at least one member selected from the group consisting of α-naphthoic acid and polyvalent metal salts thereof is(are) used as the color developing material. We have also found that when a specific class of basic dye is used in combination with α-naphthoic acid and/or a polyvalent metal salt thereof, the resulting heat-sensitive recording material is more excellent in the above properties. The present invention has been accomplished based on these findings.

The present invention provides a heat-sensitive recording material comprising (a) a support and (b) a heat-sensitive recording layer formed on the support and containing a colorless or pale-colored basic dye and a color developing material which develops a color on contact with the dye, the recording material being characterized in that the color developing material comprises at least one member selected from the group consisting of α-naphthoic acid and polyvalent metal salts thereof.

The heat-sensitive recording material of the invention is very advantageous from the view point of long-term preservation of records because, due to the use of α-naphthoic acid and/or a polyvalent metal salt thereof, the color density of the record image is sufficiently high and the record image formed is extremely stable such that the record image would not become substantially discolored or reduced in color density even when the recording material is stored in an atmosphere of high temperature or high humidity and that the record image is highly resistant to plasticizers and various solvents.

Examples of metals constituting the polyvalent metal salts of α-naphthoic acid are di-valent, tri-valent and tetra-valent metals such as zinc, calcium, magnesium, aluminum, tin, iron and the like, among which zinc is particularly preferred.

There is no specific restriction on the amount of at least one member selected from the group consisting of α-naphthoic acid and polyvalent metal salts thereof. However, it is usually preferred that said amount be adjusted to about 50 to about 700 parts by weight, preferably about 100 to about 500 parts by weight, per 100 parts by weight of the basic dye.

While color forming ability and storage stability of the heat-sensitive recording material and the stability of the record image are improved by using the above α-naphthoic acid and/or polyvalent metal salts thereof as a color developing material, these properties can be further improved by further incorporating a polyvalent metal compound into the heat-sensitive recording layer. Examples of such polyvalent metal compounds are oxides, hydroxides, aluminates, sulfides, halides, carbonates, phosphates, silicates, sulfates or nitrates of di-valent, tri-valent and tetra-valent metals such as zinc, magnesium, barium, calcium, aluminum, tin, titanium, nickel, cobalt, manganese or iron, or a mixture of these compounds. Among these, zinc compound is preferred.

Typical of such polyvalent metal compounds are zinc oxide, zinc hydroxide, zinc aluminate, zinc sulfide, zinc carbonate, zinc phosphate, zinc silicate, aluminum oxide, magnesium oxide, titanium oxide, aluminum hydroxide, aluminum silicate, aluminum phosphate, magnesium aluminate, magnesium hydroxide, magnesium carbonate, magnesium phosphate, and the like.

The polyvalent metal compounds can be used singly or in admixture.

Among the above polyvalent metal compounds, zinc oxide is particularly preferred.

There is no specific restriction on the amount of the polyvalent metal compound to be used. However, it is usually preferable to use the polyvalent metal compound in an amount of about 1 to about 500 parts by weight, preferably about 5 to about 300 parts by weight, per 100 parts by weight of at least one member selected from the group consisting of α-naphthoic acid and polyvalent metal salts thereof.

While the heat-sensitive recording material of the invention is essentially characterized by using α-naphthoic acid and/or a polyvalent metal salt thereof, a variety of known color developing materials can be used in combination with α-naphthoic acid and/or a polyvalent metal salt thereof so far as they do not impair the contemplated effect of the invention. Examples of such additional color developing materials are as follows:

aromatic carboxylic acids such as benzoic acid, 4-tert-butylbenzoic acid, 4-chlorobenzoic acid, 4-nitrobenzoic acid, phthalic acid, gallic acid, salicylic acid, 3-isopropylsalicylic acid, 3-phenylsalicylic acid, 3-cyclohexylsalicylic acid, 3,5-di-tert-butylsalicylic acid, 3-methyl-5-benzylsalicylic acid, 3-phenyl-5-($\alpha,\alpha$-dimethylbenzyl)-salicylic acid, 3,5-di($\alpha$-methylbenzyl)salicylic acid or 2-hydroxy-1-benzyl-3-naphthoic acid;

phenolic compounds such as 4,4'-isopropylidenediphenol (Bisphenol A), 4,4'-isopropylidenebis(2-chlorophenol), 4,4'-isopropylidenebis(2,6-dichlorophenol), 4,4'-isopropylidenebis(2,6-dibromophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 2,2'-bis(4-hydroxyphenyl)-4-methylpentane, 4,4'-cyclohexylidenebisphenol, 4,4'-cyclohexylidenebis(2-methylphenol), 4-tert-butylphenol, 4-'1 phenylphenol, 4-hydroxydiphenoxide, $\alpha$-naphthol, $\beta$-naphthol, methyl 4-hydroxybenzoate, benzyl 4-hydroxybenzoate, 2,2'-thiobis(4,6-dichlorophenol), 4-tert-octylcatechol, 2,2'-methylenebis(4-chlorophenol), 2,2' -methylenebis(4-chlorophenol), 2,2' -methylenebis(4-methyl-6-tert-butylphenol), 2,2'-dihydroxydiphenyl, methyl bis(4-hydroxyphenyl)acetate, ethyl bis(4-hydroxyphenyl)acetate, butyl bis(4-hydroxyphenyl)acetate, benzyl bis(4-hydroxyphenyl) acetate, 4,4'-(p-phenylenediisopropylidene)diphenol, 4,4'-(m-phenylenediisopropylidene)diphenol, 4-hydroxydiphenylsulfone, 4,4'-dihydroxydiphenylsulfone, 4,4'-dihydroxydiphenylsulfone, 2,4'-dihydroxydiphenylsulfone, 4-hydroxy-4'-methyl-diphenylsulfone, 4-4-hydroxy-4'-isopropoxydiphenylsulfone, 4-hydroxy-3',4'-tetramethylenediphenylsulfone, 3,3'-diallyl-4,4'-dihydroxydiphenylsulfone, bis(4-hydroxyphenyl)acetic acid 2-phenoxyethyl ester, p-hydroxy-N-(2-phenoxyethyl)-benzenesulfonamide, 4-hydroxyphthalic acid dimethyl ester, 1,5-bis(4-hydroxyphenylthio)-3-oxa-pentane, 1,7-bis(4-hydroxyphenylthio)-3,5-dioxa-heptane, 1,8-bis(4-hydroxyphenylthio)-3,6-dioxa-octane, (4-hydroxyphenylthio)-acetic acid 2-(4-hydroxyphenylthio)ethyl ester and the like;

phenolic resins such as p-phenylphenol-formalin resin, p-butylphenol-acetylene resin, and the like;

salts of the above-exemplified aromatic carboxylic acids, phenolic compounds or phenolic resins with polyvalent metals such as zinc, magnesium, aluminum, calcium, titanium, manganese, tin, nickel and the like; and metal complexes such as antipyrine complex of zinc thiocyanate, etc.

When used, the above additional color developing material is used in amount of 200 parts by weight or less, per 100 parts by weight of at least one member selected from the group consisting of $\alpha$-naphthoic acid and polyvalent metal salts thereof.

Colorless or pale-colored basic dyes to be used in combination with the specific color developing material in the heat-sensitive recording materials of the present invention include those conventionally known in the art. Examples of such basic dyes are triarylmethane-based dyes such as 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-(dimethylamino)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide and the like; diphenylmethane-based dyes such as 4,4'-bis-dimethylaminobenzhydrylbenzylether, N-halophenyl-leucoauramine, N-2,4,5-trichlorophenyl-leucoauramine and the like; divinylphthalide-based dyes such as 3,3-bis[1,1-bis(4-pyrrolidinophenyl)ethylen-2-yl]-4,5,6,7-tetrabromophthalide, 3,3-bis[1-(4-methoxyphenyl)-1-(4-dimethylaminophenyl-)ethylen-2-yl]-4,5,6,7-tetrachlorophthalide, 3,3-bis[1-(4-methoxyphenyl)-1-(4-pyrrolidinophenyl)ethylen-2-yl]-4,5,6,7-tetrachlorophthalide and the like; thiazine-based dyes such as benzoyl-leucomethylene blue, p-nitrobenzoyl-leucomethylene blue and the like; spiro-based dyes such as 3-methyl-spiro-dinaphthopyrane, 3-ethyl-spiro-dinaphthopyrane, 3-phenyl-spiro-dinaphthopyrane, 3-benzyl-spiro-dinaphthopyrane, 3-methyl-naphtho-(6'-methoxy-benzo)spiropyrane, 3-propyl-spiro-dibenzopyrane and the like; lactam-based dyes such as rhodamine-B-anilinolactam, rhodamine(p-nitroanilino)lactam, rhodamine(o-chloroanilino)lactam and the like; fluorene-based dyes such as 3,6-bis(dimethylamino)fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro[fluorene-9,6'-6'H-chromeno(4,3-b)indole], 3,6-bis(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole]and the like; fluoran-based dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-diethylaminofluoran, 4-benzylamino-8-diethylamino-benzo[a] fluoran, 3-[4-(4-dimethylaminoanilino)anilino]-7-chloro-6-methylfluoran, 8-4-(4-dimethylaminoanilino)anilino]-benzo[a]fluoran, 3-diethylamino-7-(2-carbomethoxyphenylamino)fluoran, 2,2-bis{4-[6'-(N-cyclohexyl-N-methylamino)-3'-methyl-spiro[phthalido-3,9'-xanthen]-2'-yl-amino]phenyl}propane, and fluoran dyes represented by the following formulas [I], [II] and [III]:

(1) a dye represented by the following formula

[I]

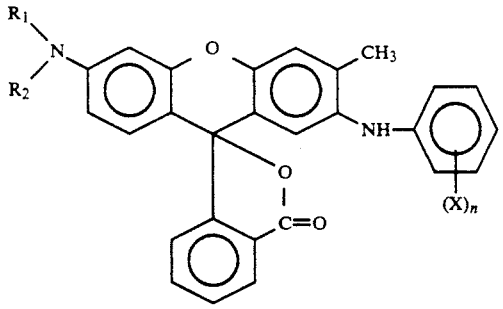

wherein $R_1$ represents $C_1$–$C_6$ alkyl group, R represents $C_1$–$C_6$ alkyl group, $C_3$–$C_6$ alkoxyalkyl group, a cyclopentyl group, a cyclohexyl group, a tetrahydrofurfuryl group or p-tolyl group, or $R_1$ and $R_2$ taken together with the nitrogen atom to which they are attached may form a pyrrolidine ring or a piperidine ring, X is a methyl group and n is 0 or an integer of 1 or 2;

(2) a dye represented by the formula

[II]

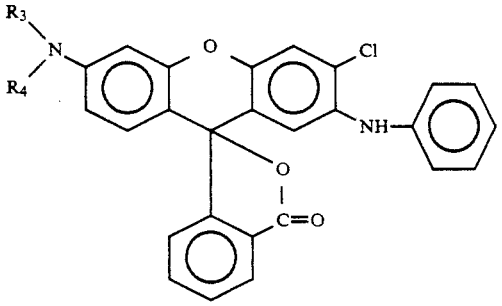

wherein $R_3$ and $R_4$ each represent $C_1$–$C_6$ alkyl group; and (3) a dye represented by the formula

[III]

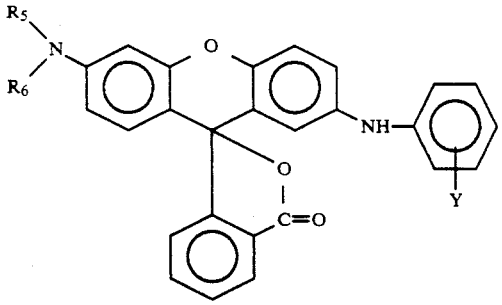

wherein $R_5$ and $R_6$ each represent $C_1$–$C_6$ alkyl group and Y represents a chlorine atom, a fluorine atom or a trifluoromethyl group.

Preferably examples of the fluoran-based dyes represented by the formula [I] are as follows:

3-diethylamino-6-methyl-7-phenylaminofluoran, 3-di-n-butylamino-6-methyl-7-phenylaminfluoran, 3-di-n-pentylamino-6-methyl-7-phenylaminofluoran, 3-(N-ethyl-p-toluidino)-6-methyl-7-phenylaminofluoran, 3-(N-ethyl-p-toluidino)-6-methyl-7-p-toluidinofluoran, 3-(N-ethyl-N-isobutylamino)-6-methyl-7-phenylaminofluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-(N-ethyl-N-tetrahydrofurfurylamino)-6-methyl-7-phenylaminofluoran, 3-(N-methyl-N-n-propylamino)-6-methyl-7-phenylaminoflruoan, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, 3-(N-methyl-N-ethoxypropylamino)-6-methyl-7-phenylaminofluoran, 3-(N-ethyl-N-ethoxypropylamino)-6-methyl-7-phenylaminofluoran, etc.

Preferable examples of the fluoran-based dyes represented by the formula [II] are as follows:

3-diethylamino-6-chloro-7-phenylaminofluoran, 3-di-n-butylamino-6-chloro-7-phenylaminofluoran, 3-di-n-pentylamino-6-chloro-7-phenylaminofluoran, 3-(N-ethyl-N-isoamylamino)-6-chloro-7-phenlaminofluoran, 3-(N-methyl-N-n-propylamino)-6-chloro-7-phenylaminofluoran, 3-(N-ethyl-N-isobutylamino)-6-chloro-7-phenylaminofluoran, 3-(N-methyl-N-n-hexylamino)-6-chloro-7-phenylaminofluoran, 3-(N-ethyl-N-n-hexylamino)-6-chloro-7-phenylaminofluoran, etc.

Preferable examples of the fluoran-based dyes represented by the formula [III] are as follows.

3-diethylamino-7-(o-chlorophenylamino)fluoran, 3-di-n-butylamino-7-(o-chlorophenylamino)fluoran, 3-dimethylamino-7-(m-trifluoromethylphenylaino)fluoran, 3-diethylamino-7-(m-trifluoromethylphenylamino)-fluoran, 3-di-n-butylamino-7-(m-trifluoromethylphenylamino)fluoran, 3-diethylamino-7-(o-fluorophenylamino)fluoran, 3-di-n-butylamino-7-(o-fluoromethylphenylamino)fluoran, 3-di-n-pentylamino-7-(o-chlorophenylamino)fluoran, 3-(N-ethyl-N-isoamylamino)-7-(o-chlorophenylamino)fluoran, 3-(N-ethyl-N-n-hexylamino)-7-(o-chlorophenylamino)fluoran, etc.

The basic dyes useful in the invention are not limited to the examples given above, and at least two of them may be conjointly used.

Among the above basic dyes, more preferable are the above-exemplified fluoran-based dyes such as those represented by the formulas [I], [II] and [III].

Of the fluoran-based dyes, particularly preferred are those represented by the following formulas [IV], [V] and [VI]:

(1) a dye represented by the formula

[IV]

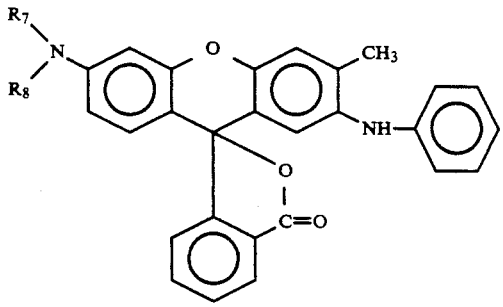

wherein $R_7$ is a methyl or ethyl group and $R_8$ is $C_3$–$C_5$ alkyl group, an ethoxypropyl group or a tetrahydrofurfuryl group, or $R_7$ and $R_8$ are the same and represent a n-butyl or n-pentyl group;

(2) a dye represented by the formula

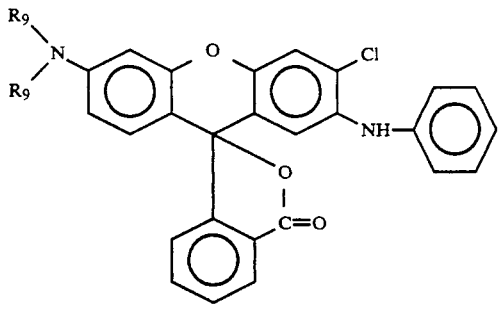

[V]

wherein $R_9$ represents an ethyl or n-butyl group; and (3) a dye represented by the formula

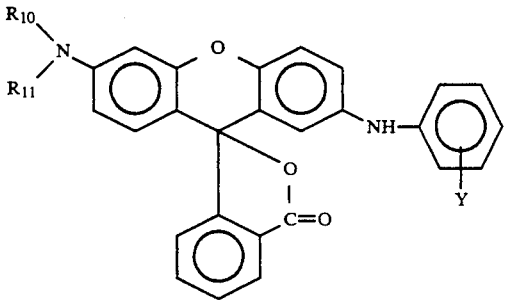

[VI]

wherein $R_{10}$ represents an ethyl or n-butyl group, $R_{11}$ represents an ethyl, n-butyl or isoamyl group and Y represents a chlorine atom, a fluorine atom or a trifluoromethyl group.

The most preferable fluoran-based dyes are 3-di-n-butylamino-6-methyl-7-phenylaminofluoran, 3-di-n-pentylamino-6-methyl-7-phenylaminofluoran, 3-diethylamino-7-(o-chlorophenylamino)fluoran, 3-di-n-butylamino-7-(o-chlorophenylamino)fluoran and 3-(N-ethyl-N-isoamylamino)-7-(o-chlorophenylamino)fluoran, since they not only afford excellent stability of the record image but also allow particularly low degree of fogging.

According to the present invention, various heat-fusible materials can be used as a recording sensitivity improving agent in order to give a heat-sensitive recording material which is more suited to high-speed recording. Such heat-fusible materials include, for example, caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2- C(4-methoxyphenoxy)ethane, terephthalic acid dibenzyl ester, dibenzyl oxalate, di(4-methylbenzyl) oxalate, p-benzyloxybenzoic acid benzyl ester, p-benzylbiphenyl, 1,5-bis(p-methoxyphenoxy)-3-oxa-pentane, 1,4-bis(2-vinyloxyethoxy)benzene, p-biphenyl p-tolyl ether, benzyl p-methylthiophenyl ether and the like.

The amount of the heat-fusible material to be used is not specifically limited and may be in the range of about 50 to about 700 parts by weight, preferably about 100 to about 500 parts by weight, per 100 parts by weight of the basic dye.

The coating composition for forming the heat-sensitive recording layer can be prepared usually by dispersing a basic dye, a color developing material and if desired a heat-fusible material conjointly or separately with an agitating and pulverizing means such as a ball mill, attritor, vertical or horizontal sand mill, colloid mill or the like using water as a dispersing medium.

The coating composition may usually contain a binder such as starches, hydroxyethyl cellulose, methyl cellulose, carboxymethyl cellulose, gelatin, casein, gum arabic, poly-vinyl alcohol, salts of styrene-maleic anhydride copolymer, salts of styrene-acrylic acid copolymer, styrene-butadiene copolymer emulsion or the like. The binder is used in an amount of about 10 to about 40% by weight, preferably about 15 to about 30% by weight, based on the total solids content of the coating composition. It is possible to use at least two of these binders in mixture.

The coating composition may further contain auxiliaries such as sodium dioctylsulfosuccinate, sodium dodecylbenzenesulfonate, sodium lauryl sulfate, metal salts of fatty acids and like dispersants, ultraviolet absorbers of the triazole type and the like, defoaming agents, fluorescent dyes, coloring dyes, etc.

To prevent the recording material from sticking to the recording device or the thermal head on contact therewith, it is possible to use a dispersion or an emulsion of stearic acid ester wax, polyethylene wax, carnauba wax, microcrystalline wax, carboxy-modified paraffin wax, zinc stearate, calcium stearate or the like.

Additionally, in order to reduce the adhesion of residual substances to the thermal head, there may be incorporated inorganic pigments such as kaolin, clay, talc, calcium carbonate, magnesium carbonate, calcined clay, titanium oxide, diatomaceous earth, particulate anhydrous silica, activated clay and the like, or organic pigments such as styrene microball, nylon powder, polyethylene powder, urea-formalin resin filler, raw starch powder and the like.

The coating composition thus prepared is applied to a suitable support such as paper, plastic film, synthetic paper, non-woven sheet or formed body by a conventional coater to produce a heat-sensitive recording material of the invention.

The amount of the coating composition to be applied is not specifically limited and is generally about 1 to about 12 g/m$^2$, preferably about 2 to about 10 g/m$^2$ on dry basis.

Other techniques used in the art for production of heat-sensitive recording materials can be employed if necessary and include, for example, provision of an overcoat layer on a heat-sensitive recording layer for protecting said recording layer and for imparting better suitability for writing, provision of a protective layer on the rear side of the heat-sensitive recording material, application of undercoats on the support, application of an adhesive on the rear side of recording material, etc.

EXAMPLES

The present invention will be described below in more detail with reference to the following examples, but the invention is not limited thereto. In the examples, "parts" and "percentages" are all by weight unless otherwise specified.

EXAMPLE 1

(1) Preparation of Dispersion A

| | |
|---|---|
| 3-Di-n-butylamino-6-methyl-7-phenylaminofluoran | 10 parts |
| 1,2-Bis(3-methylphenoxy)ethane | 20 parts |
| 5% Aqueous solution of polyvinyl alcohol | 30 parts |
| Water | 100 parts |

The mixture of these components was pulverized by a sand mill to an average particle size of 1 μm.

(2) Preparation of Dispersion B

| | |
|---|---|
| Zinc salt of α-naphthoic acid | 20 parts |
| 5% Aqueous solution of polyvinyl alcohol | 30 parts |
| Water | 50 parts |

The mixture of these components was pulverized by a sand mill to an average particle size of 2 μm.

(3) Formation of heat-sensitive recording layer

A 160 parts quantity of Dispersion A, 100 parts of Dispersion B, 30 parts of silicon oxide pigment (oil absorption: 180 ml/100g), 150 parts of a 20% aqueous solution of oxidized starch and 210 parts of water were mixed together with stirring, giving a coating composition for forming a heat-sensitive recording layer.

The coating composition thus obtained was applied to a base paper weighing 50 g/m$^2$ with use of a rod blade coater in an amount of 5.0 g/m$^2$ on dry basis and dried, giving a heat-sensitive recording paper.

EXAMPLES 2–13

Twelve kinds of heat-sensitive recording papers were prepared in the same manner as in Example 1 except that the following dye was used in place of 3-di-n-butylamino-6-methyl-7-phenylaminofluoran in the preparation of Dispersion A.

| Example | Dye |
|---|---|
| 2 | 3-di-n-pentylamino-6-methyl-7-phenylaminofluoran |
| 3 | 3-(N-ethyl-N-isoamylamino)-6-methyl-7-phenylaminofluoran |
| 4 | 3-di-n-butylamino-7-(o-chlorophenylamino)fluoran |
| 5 | 3-diethylamino-7-(o-chlorophenylamino)fluoran |
| 6 | 3-(N-ethyl-N-isoamylamino)-7-(o-chlorophenylamino)fluoran |
| 7 | 3-(N-methyl-N-n-propylamino)-6-methyl-7-phenylaminofluoran |
| 8 | 3-(N-ethyl-N-ethoxypropylamino)-6-methyl-7-phenylaminofluoran |
| 9 | 3-diethylamino-7-(o-fluorophenylamino)fluoran |
| 10 | 3-diethylamino-6-chloro-7-phenylaminofluoran |
| 11 | 3-(N-ethyl-N-tetrahydrofurfurylamino)-6-methyl-7-phenylaminofluoran |
| 12 | 3-(N-methyl-N-cyclohexylamino)-6-methyl-7-phenylaminofluoran |
| 13 | 3-pyrrolidino-6-methyl-7-phenylaminofluoran |

EXAMPLES 14 and 15

Two kinds of heat-sensitive recording papers were prepared in the same manner as in Example 1 except that in the preparation of Dispersion B calcium salt of α-naphthoic acid (Example 14) or magnesium salt of α-naphthoic acid (Example 15) was used in place of zinc salt of α-naphthoic acid.

EXAMPLE 16

A heat-sensitive recording paper was prepared in the same manner as in Example 1 except that in the preparation of Dispersion B 20 parts of α-naphthoic acid, 10 parts of zinc oxide and 40 parts of water were used in place of 20 parts of zinc salt of c-naphthoic acid and 50 parts of water.

EXAMPLES 17–20

Four kinds of heat-sensitive recording papers were prepared in the same manner as in Example 16 except that the following basic dye was used.

| Example | Dye |
|---|---|
| 17 | 3-di-n-pentylamino-6-methyl-7-phenylaminofluoran |
| 18 | 3-di-n-butylamino-7-(o-chlorophenylamino)fluoran |
| 19 | 3-diethylamino-7-(o-chlorophenylamino)fluoran |
| 20 | 3-(N-ethyl-N-isoamylamino)-7-(o-chlorophenylamino)fluoran |

EXAMPLES 21 and 22

Two kinds of heat-sensitive recording papers were prepared in the same manner as in Example 16 except that in the preparation of Dispersion B zinc salt of α-naphthoic acid (Example 21) or calcium salt of α-naphthoic acid (Example 22) was used in place of α-naphthoic acid.

EXAMPLE 23

A heat-sensitive recording paper was prepared in the same manner was in Example 1 except that in the preparation of Dispersion B 20 parts of 4-hydroxy-4'-isopropoxydiphenylsulfone and 30 parts of water were used in place of 50 parts by weight of water.

Comparative Examples 1–4

Four kinds of heat-sensitive recording papers were prepared in the same manner as in Example 1 except that in the preparation of Dispersion B the following compound was used in place of zinc salt of α-naphthoic acid.

Comparative

| Example | Compound |
|---|---|
| 1 | 4,4'-isopropylidenediphenol |
| 2 | zinc salt of 3,5-di(α-methylbenzyl)salicylic acid |
| 3 | zinc salt of 4-chlorobenzoic acid |
| 4 | zinc salt of β-naphthoic acid |

The 27 kinds of the heat-sensitive recording papers obtained above were subjected to recording with use of a facsimile machine (Model HIFAX-700, product of Hitachi, Ltd.), and the color density of the record image thus formed was measured by Macbeth densitometer (Model RD-914, product of Macbeth Corporation, U.S.A.). The results are shown in Table 1 below.

Then the heat-sensitive recording papers with the record images formed thereon were allowed to stand at 40° C. in a highly humid atmosphere of 90% RH for 48 hours. Thereafter the color density of the record images was measured again with use of the Macbeth densitometer in order to evaluate the humidity resistance of the record images. The results are shown in Table 1.

Furthermore, in order to evaluate the resistance to chemicals, a sheet of polyvinyl chloride film was superposed on the heat-sensitive recording layer each of the above heat-sensitive recording papers with the record images formed thereon with use of the above facsimile machine (resistance to plasticizer). Seperately, 0.2 ml of ethanol was applied to the heat-sensitive recording layer each of the above heat-sensitive recording papers with the record images formed thereon with use of the above facsimile machine (resistance to alcohol). In each case, the degree of fogging (i.e., undesired color formation) in the white background portions and the degree of reduction in the color density of the record images were evaluated according to the following criteria.

1: The recording paper allowing substantially no fogging or substantially no reduction in color density, raised no practical problem at all and was rated excellent.

2.: The recording paper allowed slight degree of fogging or slight degree of reduction in color density, raised no practical problem and was rated good.

3: The recording paper allowed fogging or reduction in color density and had a bit low quality but was practically usable.

4: The recording paper suffered from marked fogging or marked reduction in color density, and raised practical problem.

The results are shown in Table 1.

As clear from Table 1, the heat-sensitive recording material of the invention can give record images which have high color density and excellent stability, and has high resistance to chemicals.

TABLE 1

| | | | Resistance to plasticizer | | Resistance to alcohol | |
|---|---|---|---|---|---|---|
| | Color density | Humidity resistance of record image | Fogging | Reduction in color density | Fogging | Reduction in color density |
| Ex. 1 | 1.25 | 1.21 | 2 | 2 | 1 | 2 |
| Ex. 2 | 1.24 | 1.21 | 2 | 2 | 1 | 2 |
| Ex. 3 | 1.25 | 1.22 | 2 | 2 | 2 | 2 |
| Ex. 4 | 1.23 | 1.20 | 2 | 2 | 1 | 2 |
| Ex. 5 | 1.22 | 1.20 | 2 | 2 | 1 | 2 |
| Ex. 6 | 1.24 | 1.21 | 2 | 2 | 1 | 2 |
| Ex. 7 | 1.23 | 1.20 | 2 | 2 | 2 | 2 |
| Ex. 8 | 1.24 | 1.21 | 2 | 2 | 2 | 2 |
| Ex. 9 | 1.23 | 1.20 | 2 | 2 | 2 | 2 |
| Ex. 10 | 1.24 | 1.21 | 2 | 2 | 2 | 2 |
| Ex. 11 | 1.25 | 1.22 | 2 | 2 | 2 | 2 |
| Ex. 12 | 1.23 | 1.20 | 3 | 2 | 2 | 2 |
| Ex. 13 | 1.22 | 1.20 | 3 | 2 | 2 | 2 |
| Ex. 14 | 1.21 | 1.13 | 2 | 3 | 2 | 3 |
| Ex. 15 | 1.20 | 1.12 | 2 | 3 | 2 | 3 |
| Ex. 16 | 1.29 | 1.25 | 2 | 1 | 1 | 2 |
| Ex. 17 | 1.28 | 1.24 | 2 | 1 | 1 | 2 |
| Ex. 18 | 1.27 | 1.24 | 2 | 1 | 1 | 2 |
| Ex. 19 | 1.26 | 1.23 | 2 | 1 | 1 | 2 |
| Ex. 20 | 1.28 | 1.25 | 2 | 1 | 1 | 2 |
| Ex. 21 | 1.30 | 1.28 | 2 | 1 | 1 | 2 |
| Ex. 22 | 1.29 | 1.27 | 2 | 1 | 1 | 2 |
| Ex. 23 | 1.32 | 1.27 | 2 | 2 | 2 | 2 |
| Comp. Ex. 1 | 1.08 | 0.85 | 2 | 4 | 4 | 4 |
| Comp. Ex. 2 | 1.13 | 0.98 | 4 | 3 | 4 | 3 |
| Comp. Ex. 3 | 0.98 | 0.89 | 4 | 3 | 4 | 3 |
| Comp. Ex. 4 | 0.95 | 0.78 | 2 | 4 | 2 | 4 |

We claim:

1. A heat-sensitive recording material comprising (A) a support and (B) a heat-sensitive recording layer formed on the support and containing a colorless or pale-colored basic dye and a color developing material which develops a color on contact with the dye, the recording material being characterized in that the color developing material comprises at least one member selected from the group consisting of α-naphthoic acid and polyvalent metal salts thereof.

2. A heat-sensitive recording material according to claim 1 wherein the heat-sensitive recording layer further contains a polyvalent metal compound or compounds.

3. A heat-sensitive recording material according to claim 1 wherein the polyvalent metal salt is zinc salt of α-naphthoic acid.

4. A heat-sensitive recording material according to claim 1 wherein the heat-sensitive recording layer further contains a polyvalent metal compound or compounds.

5. A heat-sensitive recording material according to claim 4 wherein the polyvalent metal compound or compounds is an oxide, hydroxide, aluminate, sulfide, halide, carbonate, phosphate, silicate, sulfate or nitrate of a di-valent, tri-valent or tetra-valent metal selected from the group consisting of zinc, magnesium, barium, calcium, aluminum, tin, titanium, nickel, cobalt, manganese and iron, or a mixture of these compounds.

6. A heat-sensitive recording material according to claim 4 wherein the polyvalent metal compound or compounds is zinc oxide, zinc hydroxide, zinc aluminate, zinc sulfide, zinc carbonate, zinc phosphate, zinc silicate, aluminum oxide, magnesium oxide, titanium oxide, aluminum hydroxide, aluminum silicate, aluminum phosphate, magnesium aluminate, magnesium hydroxide, magnesium carbonate, magnesium phosphate or a mixture of these.

7. A heat-sensitive recording material according to claim 4 wherein the polyvalent metal compound or compounds is zinc oxide, zinc hydroxide, zinc aluminate, zinc sulfide, zinc carbonate, zinc phosphate, zinc silicate or a mixture of these.

8. A heat-sensitive recording material according to claim 4 wherein the polyvalent metal compound is zinc oxide.

9. A heat-sensitive recording material according to claim 4 wherein the polyvalent metal compound is used in an amount of about 1 to about 500 parts by weight, per 100 parts by weight of at least one member selected from the group consisting of α-naphthoic acid and polyvalent metal salts thereof.

10. A heat-sensitive recording material according to claim 1 wherein the basic dye is a basic dye represented by the following formula

[I]

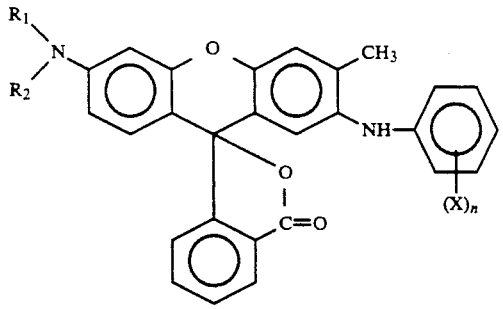

wherein $R_1$ represents $C_1$–$C_6$ alkyl group, $R_2$ represents $C_1$–$C_6$ alkyl groups, $C_3$–$C_6$ alkoxyalkyl group, a cyclopentyl group, a cyclohexyl group, a tetrahydrofurfuryl group or p-tolyl group, or $R_1$ and $R_2$ taken together with the nitrogen atom to which they are attached form a pyrrolidine ring or a piperidine ring, X is a methyl group and n is 0, 1 or 2.

11. A heat-sensitive recording material according to claim 1 wherein the basic dye is a basic dye represented by the formula

[II]

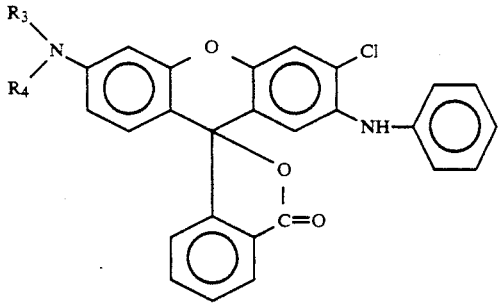

wherein $R_3$ and $R_4$ each represent $C_1$–$C_6$ alkyl group.

12. A heat-sensitive recording material according to claim 1 wherein the basic dye is a basic dye represented by the formula

[III]

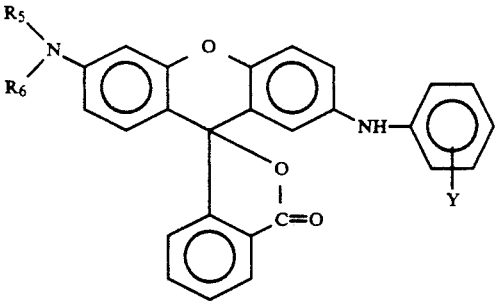

wherein $R_5$ and $R_6$ each represent $C_1$–$C_6$ alkyl group and Y represents a chlorine atom, a fluorine atom or a trifluoromethyl group.

13. A heat-sensitive recording material according to claim 1 wherein the basic dye is a basic dye represented by the formula

[IV]

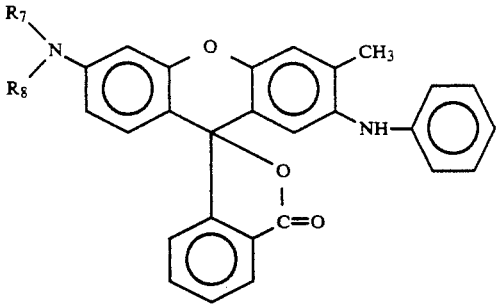

wherein $R_7$ is a methyl or ethyl group and $R_8$ is $C_3$–$C_5$ alkyl group, an ethoxypropyl group or a tetrahydrofurfuryl group, or $R_7$ and $R_8$ are the same and represent a n-butyl or n-pentyl group.

14. A heat-sensitive recording material according to claim 1 wherein the basic dye is a basic dye represented by the formula

[V]

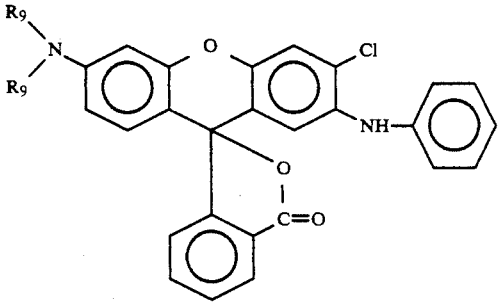

wherein $R_9$ represents an ethyl or n-butyl group.

15. A heat-sensitive recording material according to claim 1 wherein the basic dye is a basic dye represented by the formula

[VI]

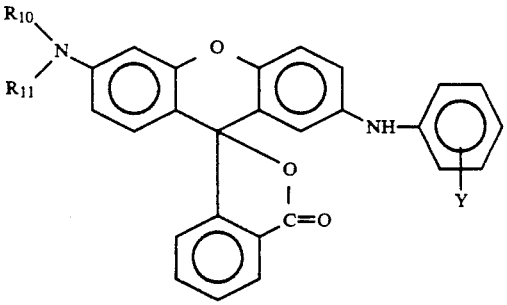

wherein $R_{10}$ represents an ethyl or n-butyl group, $R_{11}$ represents an ethyl, n-butyl or isoamyl group and Y represents a chlorine atom, a fluorine atom or a trifluoromethyl group.

16. A heat-sensitive recording material according to claim 1 wherein the basic dye is 3-di-n-butylamino-6-methyl-7-phenylaminofluoran.

17. A heat-sensitive recording material according to claim 1 wherein the basic dye is 3-di-n-pentylamino-6-methyl-7-phenylaminofluoran.

18. A heat-sensitive recording material according to claim 1 wherein the basic dye is 3-diethylamino-7-(o-chlorophenylamino)fluoran.

19. A heat-sensitive recording material according to claim 1 wherein the basic dye is 3-di-n-butylamino-7-(o-chlorophenylamino)fluoran.

20. A heat-sensitive recording material according to claim 1 wherein the basic dye is 3-(N-ethyl-N-isoemylamino)-7-(o-chlorophenylamino)fluoran.

* * * * *